US005230136A

United States Patent [19]

Cronn et al.

[11] Patent Number: 5,230,136

[45] Date of Patent: Jul. 27, 1993

[54] PUNCH AND DIE SET FOR SHEET METAL CLINCHING

[75] Inventors: Gary M. Cronn, Mount Clemens; Ronald J. Eisbrenner, Shelby Township, Macomb County; Charles L. Desmet, Fraser, all of Mich.

[73] Assignee: Savair Inc., St. Clair Shores, Mich.

[21] Appl. No.: 878,441

[22] Filed: May 4, 1992

[51] Int. Cl.[5] ..... B21D 39/00; B23P 11/00

[52] U.S. Cl. ..... 29/521; 29/243.5; 29/798

[58] Field of Search ..... 29/432, 432.1, 432.2, 29/509, 243.5, 522.1, 521, 798; 72/395, 396, 470; 403/274, 393

[56] References Cited

U.S. PATENT DOCUMENTS

| | | | |
|---|---|---|---|
| 3,726,000 | 4/1973 | Hafner | 29/432 X |
| 3,871,264 | 3/1975 | Hallock | 29/432 X |
| 3,919,955 | 11/1975 | DuVernay | 29/432 X |
| 4,064,617 | 12/1977 | Oaks | 29/432 X |
| 4,449,428 | 5/1984 | Francis | 29/432 X |
| 4,459,735 | 7/1984 | Sawdon . | |
| 4,584,753 | 4/1986 | Eckold et al. . | |
| 4,614,017 | 9/1986 | Eckold et al. . | |
| 4,658,502 | 4/1987 | Eckold et al. . | |
| 4,757,609 | 7/1988 | Sawdon . | |
| 4,910,853 | 3/1990 | Sawdon . | |
| 4,928,370 | 5/1990 | Eckold et al. . | |
| 4,972,565 | 11/1990 | Eckold et al. . | |
| 5,027,503 | 7/1991 | Sawdon . | |
| 5,031,442 | 7/1991 | Kynl . | |
| 5,046,228 | 9/1991 | Eckold et al. . | |

FOREIGN PATENT DOCUMENTS

| | | | |
|---|---|---|---|
| 3923182 | 1/1991 | Fed. Rep. of Germany | 29/432 |

*Primary Examiner*—Timothy V. Eley
*Attorney, Agent, or Firm*—Remy J. VanOphem

[57] ABSTRACT

A die for use with a conventional punch to mechanically join, or clinch, two or more sheets of metal or other suitably formable material. The die is specially formed with a cavity having one or more lateral passages extending from the periphery of the cavity. When the sheets are positioned against the die and impacted by a suitable punch, the lateral passages permit the lateral extrusion of a quantity of sheet material which serves to mechanically interlock the sheets. The die has no moving parts itself, providing an economical design which is adaptable to various types of presses and applications. Moreover, the lateral passages can accommodate sheet material of various thicknesses and yet create a sufficient clinching effect without the need to closely calibrate the punch or press used with the die.

22 Claims, 1 Drawing Sheet

PUNCH AND DIE SET FOR SHEET METAL CLINCHING

BACKGROUND OF THE INVENTION

1. Field of the Invention

The present invention generally relates to punch and die sets used to join sheet metal as an alternative to welding. More specifically, this invention relates to a die having a specially formed cavity with peripheral interruptions, wherein the peripheral interruptions provide a limited amount of lateral extrusion of the sheet metal so as to improve the clinching strength of the resulting joined sheets.

2. Description of the Prior Art

Welding has long been a widely accepted method of joining sheet metal, particularly in the automotive and appliance industries. However, welding is recognized as having significant disadvantages, including the destruction of coating materials and its detrimental effect on corrosion-resistant alloys and metals which have undergone surface treatments. Welding has also become less desirable with the intensified concern for the environmental effects of its gases and flux residue.

In eliminating welding as a method for joining sheet metal of thicknesses between about 0.02 and 0.05 inches, various approaches have been suggested for using punch and die sets which are adapted to permanently join, or clinch, two or more sheets of metal. Generally, punch and die sets have some advantages over welding, including lower maintenance costs and lower power requirements to operate the device. However, the primary disadvantage with joints formed using punch and die sets is that they exhibit lower tensile and shear strength. It is inherent that the joint produced must be sufficiently strong for purposes of the particular application. As examples, where automotive hood and door panels or washing machine panels are to be joined, joints can be subjected to significant fatigue, shear and tensile loading. Accordingly, strength of the joint is a critical criterion for evaluating its suitability for a given application. In addition, the emphasis on providing leakproof joints precludes the use of conventional punch and die sets that pierce the metal sheets.

U.S. Pat. No. 3,579,809 to Wolf et al. is an early example of a die which was specifically adapted to provide a method of clinching metal sheets capable of producing a relatively high strength, leakproof joint. The method entailed positioning an anvil between a pair of die blocks resiliently biased toward the anvil. The anvil was recessed below the upper surfaces of the die blocks to provide a forming space between the die blocks. Two sheets of metal could then be placed upon the die blocks over the anvil, and a punch impacted against the sheets in axial alignment with the anvil such that the anvil served as a mechanical stop for the punch. The punch would form concentric bosses in the sheets without breaking through the joined metal. During the operation of the punch, the die blocks would slide apart against the opposing biasing force, allowing the sheets to plastically extrude laterally in all directions from the concentric bosses formed in the sheets. The lateral extrusions would serve to interlock the bosses, thereby forming a permanent joint able to withstand both shear and tensile loads in the plane of the sheets and in the axial direction of the bosses, respectively.

U.S. Pat. No. 4,459,735 to Sawdon taught a similar approach in which the sliding die blocks were replaced by pivoting die blocks. The die blocks were biased toward the anvil in a scissor-like fashion by a compression spring. As with the teachings of Wolf et al., the effect of allowing the die blocks to pivot was to allow lateral expansion of the bosses in the region abutting the anvil to interlock the sheets being joined. Sawdon placed particular emphasis on the importance of maintaining the thickness of the sheets at the center of the joint according to the formula:

$$T=0.2(1.2(M_1+M_2));$$

where T is the total metal thickness at the center of the joint, and $M_1$ and $M_2$ are the top and bottom panel thicknesses, respectively, prior to the joining operation. Joints formed in adherence to this approach exhibited higher joint strength, but the approach necessitated that the press or punch apparatus be calibrated to take into account the original thicknesses of the panels. U.S. Pat. Nos. 4,757,609, 4,910,853 and 5,027,503 to Sawdon and U.S. Pat. No. 5,031,442 to Kynl introduced the use of an elastic band in place of the spring to resiliently bias the die blocks toward the anvil.

Though the Sawdon approach has been widely followed in the industry, the adherence to the above formula has posed a significant disadvantage in that panel thicknesses may vary sufficiently to require modification of the punch and die apparatus to achieve the preferred joint thickness. In addition, a primary disadvantage of Wolf et al. remained with the Sawdon approach in that mechanical movement of the die blocks was necessary to produce the lateral extrusion needed to lock the sheets together. The resulting die construction was rather large and cumbersome as well as expensive compared to using a one-piece anvil alone without movable die blocks.

In contrast, the approach taught by U.S. Pat. No. 4,584,753 to Eckold et al. avoided the use of mechanically movable die blocks by forming the die blocks as cantilevered members extending from a base to circumscribe the anvil. Accordingly, the resilient nature of the material from which the cantilevered members were formed allowed the cantilevered members to resiliently deflect outward during the operation of the punch to allow the lateral extrusion of the sheets to occur. Further adaptations of this principle are taught in U.S. Pat. Nos. 4,614,017, 4,658,502, 4,928,370, 4,972,565 and 5,046,228 to Eckold et al. However, the disadvantage of relying upon movable die blocks remained an important feature in the operation of the Eckold et al. punch and die apparatus.

An example of a punching process for clinching metal sheets which does not rely upon movable die blocks is illustrated in U.S. Pat. No. 4,911,591 to Oaks. Similar to the teachings of Sawdon and Eckold et al., Oaks also relies upon laterally extruding some of the sheet material to interlock the sheets. However, Oaks differs in that the interlocking occurs between a portion of one sheet which is extruded by a punch into a recess previously formed in the second sheet. This approach eliminates the need for die blocks which either slide, pivot or deflect relative to the anvil. However, a disadvantage to the teachings of Oaks is that the second sheet must first undergo an initial operation to displace a portion thereof to form the recess.

From the above discussion, it can be readily appreciated that the prior art does not disclose a device for a one-step joining operation for sheet metal in which the die is a unitary piece having no movable parts. Nor does the prior art teach or suggest a method which does not entail either preforming one of the sheets to form a recess therein, or resiliently expanding a portion of the die to accommodate the extrusion of one or more of the metal sheets to effectively and permanently clinch the sheets in a manner that provides a leakproof joint.

Accordingly, what is needed is a cost-efficient, one-piece die for use with conventional presses which, in cooperation with a conventional punch, is capable of joining together one or more metal sheets of various thicknesses without the need for the die to include movable parts and without the need to provide extensive preparation of the metal sheets prior to joining.

SUMMARY OF THE INVENTION

According to the present invention there is provided a die for use with a conventional punch to permanently join, or clinch, two or more sheets of metal or other suitably formable material. The die is specially formed to both receive the punch and provide one or more lateral passages which permit the extrusion of a quantity of sheet material which serves to interlock the sheets. The die has no moving parts itself, providing an economical design which is adaptable to various types of presses and applications. Moreover, the lateral passages can accommodate sheet material of various thicknesses and yet create a sufficient clinching effect without the need to closely calibrate the punch or press used with the die.

Essentially, the die is part of a conventional punch and die set which uses a punch having a circular cross section, though other forms such as oval and rectangular cross sections can foreseeably be used with satisfactory results. The die is adapted to cooperate with the punch to perform a clinching and joining operation. Fundamentally, the die serves as an anvil having a designated impact surface against which the punch impacts. More importantly, the impact surface of the die also defines a peripheral wall circumscribing a recess which determines the shape of the joint, serves as a pilot for the punch, and otherwise influences the manner in which the materials are to be joined. The punch is axially aligned with the die and propelled toward the impact surface, either by hand or by a mechanical device such as an impact gun or a press.

For purposes of the present invention, the recess, or cavity, formed in the surface of the die may have any shape, though preferably the cross-sectional shape of the cavity closely corresponds to that of the punch. Suitable clearance between the punch and the cavity ensures that the punch will not pierce or break through the sheets being joined. The cavity defines a peripheral edge with the impact surface of the die. Also formed in the impact surface so as to be contiguous with the cavity is at least one peripheral interruption that intersects the cavity's periphery. The peripheral interruption is preferably recessed in the end surface of the die to provide an extrusion path for the sheet material as well as to provide additional surrounding sheet material to be drawn into the die cavity when the punch impacts the sheet metal as it is held upon the die. The extruded portion of the sheet material provides mechanical clinching between the sheets to form a permanent leakproof joint.

To provide a uniform clinching action between the sheets of formable material, it is preferable that several equally-spaced peripheral interruptions are arranged in a radially extending manner from the cavity to provide several passages through which the extruded sheet material may flow. Also, to accommodate various thicknesses of sheet material, it is preferable that the peripheral interruptions extend across the full width of the impact surface. As a result, the peripheral interruptions provide unlimited lateral extrusion of the sheet material from the die cavity.

According to a preferred aspect of this invention, the peripheral interruptions formed in the periphery of the cavity provide passages through which the sheet material can plastically extrude during the punching operation. As a result, the sheet material is deformed into the cavity by the punch, with a portion of the deformed material being extruded into the passages. The upper sheet of material will extrude furthest into the passage, with the lower sheet closely conforming with the upper sheet to form a lateral protrusion.

The lateral protrusion serves to interlock the sheets in the direction of the punch's travel to prevent relative movement between the sheets. The deformation in the sheets corresponding to the cavity serves as the primary restraint to movement between the sheets in the plane of the sheets. What results is a joining between the sheets that is capable of withstanding fatigue, shear and tensile loading between the sheets to a greater degree than that of the prior art. In addition, the joint is accomplished without break-through between the sheets in order to ensure a leakproof joint which is suitable for forming liquid containers and various other articles in which liquid-tight construction is critical, i.e. corrosive atmosphere.

Another significant advantage of the present invention is that the construction of the die is simplified, being a one-piece die construction forming an anvil and cavity in which the punch is to be received. It is unnecessary to provide sliding, pivoting or resilient die blocks for accommodating the extrusion of the sheet material. As a result, the die is readily adaptable to conventional punch and press devices and automated machines. Moreover, due to its compact construction the die can be employed where use of punch and die sets of the prior art would be cumbersome or impossible due to space limitations.

Accordingly, it is an object of the present invention to provide a die for a punch or press operation in which two or more sheets of material are to be clinched to form a leakproof permanent joint.

It is a further object of the invention that the die be a one-piece die having no movable parts.

It is still a further object of the invention that the die include an anvil surface having a cavity or recess into which the sheets are to be deformed by a punch.

It is another object of the invention that the cavity be defined by a periphery having at least one interruption which is contiguous with the cavity through which a portion of the sheets can be plastically extruded.

It is yet another object of the invention that the interruptions be in the form of elongate passages recessed below the anvil surface of the die, wherein the capacity of the passages is sufficient for clinching sheets of various thicknesses.

It is still another object of the invention that the peripheral interruptions be equally-spaced along the periphery of the cavity to uniformly distribute tensile and shear loads between the sheets.

Other objects and advantages of this invention will be more apparent after a reading of the following detailed description taken in conjunction with the drawings provided.

DETAILED DESCRIPTION OF THE PREFERRED EMBODIMENT

Figure 1:
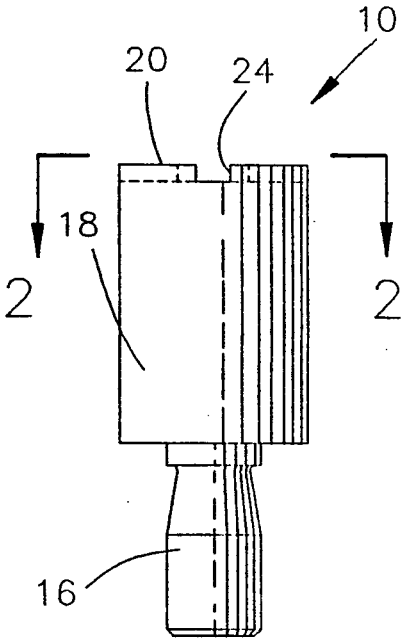
FIG. 1 is a side view of a die in accordance with the preferred embodiment of this invention.

With reference to FIGS. 1 through 4, there is shown a die 10 for use with a punch 28 or press operation in which two or more sheets of metal or other suitably formable material can be permanently joined. The punch 28 can be of a type conventionally known, such as that shown in FIGS. 3 and 4 in which an end 26 of the punch 28 has a circular cross-section. It is entirely forseeable that punches having an oval, rectangular or other form of cross-section can be used with satisfactory results. The die 10 is sufficiently sized to accommodate the end 26 of the punch 28 and to absorb the impact of the punch 28 for performing the clinching operation of the present invention. The die 10 serves primarily as a one-piece anvil which provides a durable surface against which the punch 28 interacts. In use, the punch 28 is axially aligned with the die 10, two or more sheets of metal (depicted in FIGS. 3 and 4 as an upper sheet 12 and a lower sheet 14), or other suitably formable material, are positioned over the die 10, and the end 26 of the punch 28 is then impacted against the sheets 12 and 14 and die 10, either by hand or by a mechanized device such as a press or impact gun (not shown).

Figure 2:
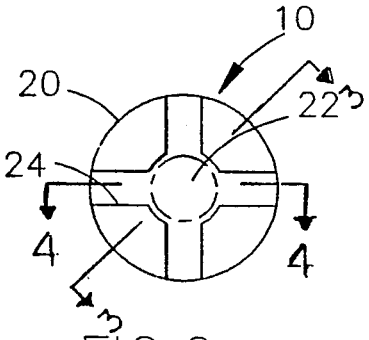
FIG. 2 is an end view taken along lines 2—2 of the die of FIG. 1 illustrating a cavity and extrusion channels in accordance with the preferred embodiment of this invention.

As illustrated in FIGS. 1 and 2, the die 10 includes a cylindrical body 18 which is intended to fit within a cavity (not shown) formed in the press device (not shown) to be aligned with the punch 28. The die 10 is preferably formed with a base 16 which is suitably formed to allow a clamp or set screw to retain the die 10 within the cavity. Disposed opposite the base 16 is an anvil surface 20 oriented transverse to the axis of the die 10. As seen in the end view of FIG. 2, there is a recess or cavity 22 formed in the anvil surface 20 from which four equally-spaced lateral channels 24 extend radially. Consequently, the lateral channels 24 are essentially peripheral interruptions in the otherwise enclosed periphery of the cavity 22. For purposes of this embodiment, a cylindrical recess or cavity is shown. However, it is understood that any form of recess in the anvil surface with an associated interruption in the periphery of the recess may be used.

In an embodiment used for testing, the diameter of the cavity 22 was approximately 0.22 inches, necessitating the end 26 of the punch 28 having a somewhat smaller diameter. The width of the lateral channels 24 was approximately 0.09 inches, while the length of the lateral channels 24 extended to the outer perimeter of the anvil surface 20. As tested, the diameter of the anvil surface 20 was approximately 0.5 inches, though it is entirely foreseeable that an anvil surface 20 having a greater or lesser diameter, or longer or shorter lateral channels 24 could be employed without a significant effect on the practice of the present invention.

In addition, the depth of both the cavity 22 and lateral channels 24 was about 0.05 inches from the anvil surface 20 with a draft angle of approximately 7 degrees. However, the depth or draft angle can be altered to accommodate much thicker or thinner materials, or materials having significantly different flow characteristics during extrusion. Moreover, the lateral channels 24 need not be coplanar with the lower surface of the cavity 22, but may be recessed slightly above or below the recessed plane defined by the cavity 22. The number, spacing and orientation of the lateral channels 24 can also be altered for adaptation to different sheet materials and applications. However, a particular advantage to the use of the lateral channels 24 is their capacity to accommodate the material extruded from sheets 12 and 14 of various thicknesses without necessitating a modification to the cavity 22 or the lateral channels 24. Accordingly, what is primarily important is that the lateral channels 24 be contiguous with the cavity 22 in a manner that allows material to flow into the lateral channels 24 during the punching operation.

Figure 3:
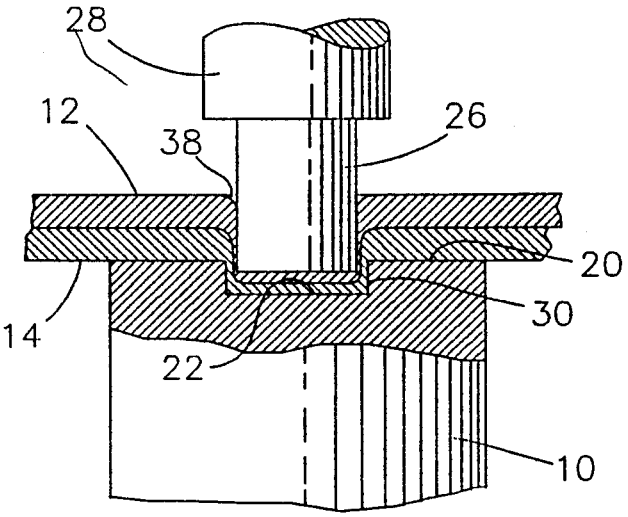
FIG. 3 is a partial cross-sectional view taken along lines 3—3 of FIG. 2 of the die of the present invention wherein a pair of metal sheets are being impacted by a punch.
Figure 4:
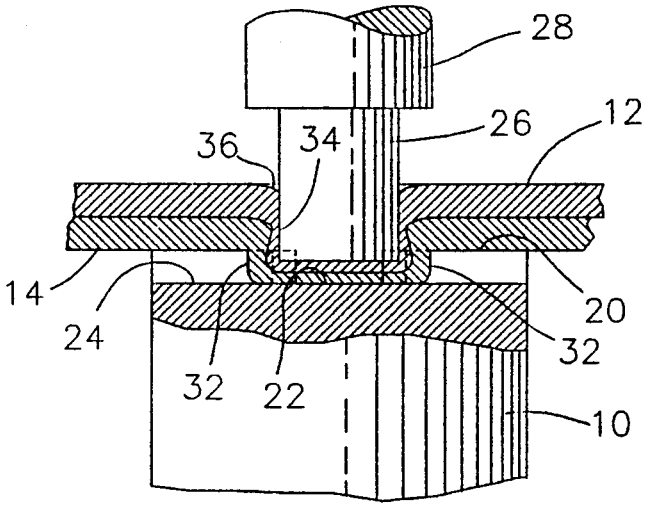
FIG. 4 is a partial cross-sectional view similar to FIG. 3 taken along line 4—4 of FIG. 2.

In operation, the die 10 is supported by any suitable means to be axially aligned below the punch 28. A pair of metal sheets 12 and 14 are then placed upon the die 10, and the punch 28 is brought to bear against the upper sheet 12 with sufficient force to deform the metal sheets 12 and 14 into the cavity 22 of the die 10, as seen in FIGS. 3 and 4. FIG. 3 depicts a partial cross-sectional view of the punch 28 engaged with the metal sheets 12 and 14 and the cavity 22, in which the cross section is taken across a diameter through an uninterrupted portion of the cavity 22. As seen, both upper and lower sheets 12 and 14 are severely deformed to extend through the gap between the cavity 22 and the punch 28, forming a cylindrical boss 30. The diameter of the cylindrical boss 30 is equal to the diameter of the cavity 22.

Figure 5:
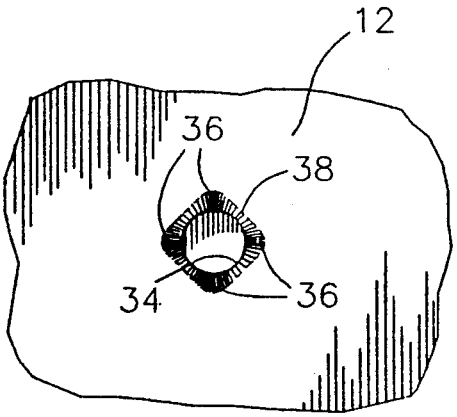
FIG. 5 is a plan view of the upper sheet of FIGS. 3 and 4 illustrating the deformation pattern in its upper surface.
Figure 6:
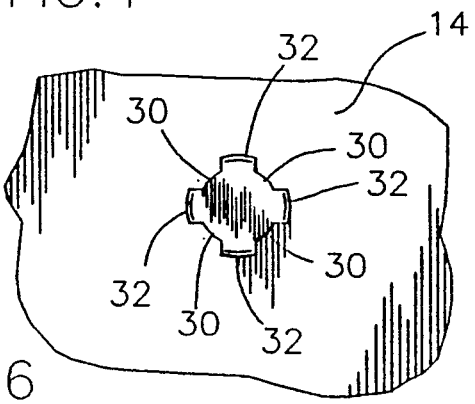
FIG. 6 is a bottom view of the lower sheet of FIGS. 3 and 4 illustrating the deformation pattern in its lower surface.

In contrast, FIG. 4 depicts a cross section taken through an opposite pair of lateral channels 24, illustrating the manner in which both sheets 12 and 14 laterally extrude into the lateral channels 24 to form lateral protrusions 32 on the otherwise cylindrical boss 30. The lateral protrusions 32 project below the lower surface of the lower sheet 14 through their respective lateral channels 24 to interlock the upper and lower sheets 12 and 14, thereby forming a permanent joint. Viewing the joint from the side of the upper sheet 12 as shown in FIG. 5, the joint appears to be essentially a circular recess 34 within a square depression 38 in the upper sheet 12. Viewing the joint from the side of the lower sheet 14 as shown in FIG. 6, the cylindrical raised boss 30 is prominent, with the lateral protrusions 32 extending radially therefrom. Appearances indicate that the corners 36 of the square depression seen in the upper sheet 12 result from the flow of material into the lateral channels 24 to form the lateral protrusions 32. Otherwise, both the upper and lower sheets 12 and 14 remain virtually unaffected by the punch and die operation of the present invention.

Laboratory testing in accordance with the teachings of the present invention has indicated an improvement in shear strength above the joint formed by the teachings of Sawdon (U.S. Pat. No. 4,459,735, supra). With reference to FIG. 3, punching operations performed on sheets 12 and 14 of #1008 cold roll steel having thicknesses of 0.042 inches (19 gauge) resulted in combined radial thicknesses of between 0.005 and 0.008 inches through the cylindrical boss 30, and 0.040 inches through the axial end surface of the cylindrical boss 30. In contrast, with reference to FIG. 4 the radial thickness of the cylindrical boss 30 was approximately 0.025 inches, with the lateral protrusions 32 extending radially an additional 0.044 inches to interlock the lower sheet 14 with the upper sheet 12. Testing with metal sheets 12 and 14 of different compositions and thicknesses has indicated similar improvements over the prior art, though with obvious differences in dimensions due to the different materials and thicknesses used.

Accordingly, a significant advantage of the die 10 of the present invention is that the lateral channels 24 formed in the periphery of the cavity 22 provide equally-spaced passages through which the metal sheets 12 and 14 can each plastically extrude during the punching operation to form a leakproof joint that exhibits superior shear strength when compared to similarly formed joints of the prior art. The metal sheets 12 and 14 are deformed into the cavity 22 by the punch 28, with a portion of the deformed material being extruded into the lateral channels 24 to form the lateral protrusions 32 which project from the boss 30 formed by the remainder of the cavity 22. Each lateral protrusion 32 serves to interlock the metal sheets 12 and 14 in the direction of the punch's travel to furnish increased tensile strength to the joint for resisting relative movement between the sheets 12 and 14 under load. The deformation in the sheets 12 and 14 corresponding to the cavity 22 serves as the primary restraint to movement between the sheets 12 and 14 in the plane of the sheets 12 and 14, while additional strength is furnished by the manner in which the upper and lower sheets 12 and 14 extrude together beneath the lower sheet 14 and into the lateral channels 24. The joint also exhibits improved shear and tensile strength between the sheets to a greater degree than that of the prior art.

Another significant advantage of the present invention is that the construction of the die 10 is a one-piece die forming the anvil surface 20 and the cavity 22 in which the punch 28 is received. In contrast to the prior art, it is unnecessary to provide sliding, pivoting or resilient die blocks for accommodating the extrusion of the sheet metal. As a result, the die 10 is readily adaptable to conventional punch and press devices and automated machines and can be employed without concern for limited operating space.

In addition, the advantages of the adjustment device can be realized with sheet material of various thicknesses. The lateral channels 24 are sufficiently sized to accommodate varying degrees of lateral extrusion by the sheet material from the die cavity 22. As a result, modifications or adaptations to the die 10 are unnecessary to attain acceptable results with sheets varying in number and thickness within a significant range.

Accordingly, the present invention provides a die 10 suitable for forming permanent joints, or clinches, between two or more sheets of metal or other suitably formable material. The die 10 is specially formed to both receive a conventional punch within the cavity 22 formed therein and provide one or more lateral channels 24 which permit the extrusion of a quantity of the sheet metal material. The lateral protrusions 32 formed by the above process serve to interlock the sheets. The die 10 has no moving parts itself, providing a economical design which is adaptable to various types of presses and applications. Moreover, the lateral channels 24 can accommodate sheet metal of various thicknesses and yet create a sufficient clinching effect without the need to closely calibrate the punch or press used with the die 10.

While the invention has been described in terms of a preferred embodiment, it is apparent that other forms could be adopted by one skilled in the art. Accordingly, the scope of the invention is to be limited only by the following claims.

What is claimed is:

1. A method for forming a substantially leakproof joint between sheet material, said method comprising the steps of:

superimposing at least two said sheets of material on a one-piece die having a cavity with at least one peripheral interruption;

impacting said at least two sheets of material against said one-piece die, said step of impacting including the steps of:

deforming said at least two sheets of material into said cavity; and simultaneously deforming a portion of said at least two sheets of material into said at least one peripheral interruption such that said at least two sheets of material are not pierced;

whereby said at least one peripheral interruption provides an extrusion path for a portion of said at least two sheets of material when impacted against said one-piece die, said at least two deformed sheets of material providing mechanical interlocking between said at least two sheets of material to join said at least two sheets of material so as to form a substantially leakproof joint therebetween.

2. The method of claim 1 wherein said step of impacting said at least two sheets of material includes deforming said portion of said at least two sheets of material laterally into said at least one peripheral interruption.

3. The method of claim 1 wherein said step of impacting includes deforming said portion of said at least two sheets of material laterally relative to said cavity into a plurality of peripheral interruptions.

4. The method of claim 1 wherein said step of impacting includes extruding a portion of each said at least two sheets of material into said at least one peripheral interruption.

5. The method of claim 1 wherein said step of impacting includes impacting said at least two sheets of material with a substantially cylindrical punch.

6. A method for joining at least two sheets of material without piercing said at least two sheets of material, said method comprising the steps of:

superimposing said at least two sheets of material on a one-piece die so as to face a lower surface toward said one-piece die and an upper surface away from said one-piece die, said one-piece die having an end surface with a cavity formed therein and a plurality of channels extending from said cavity;

aligning a punch with said cavity in said one-piece die moving said punch into said at least two sheets of material in a direction toward said end surface of said one-piece die, said step of moving including the steps of:

drawing said at least two sheets of material into said cavity to form a recess in said upper surface of said at least two sheets of material and a boss in said lower surface of said at least two sheets of material; and simultaneously extruding a portion of each said at least two sheets of material into said plurality of channels such that said at least two sheets of material are not pierced, said portion of each said at least two sheets of material forming a plurality of protrusions projecting in a direction away from said boss;

whereby said plurality of channels provide extrusion paths in a direction away from said boss when said punch is moved into said at least two sheets of material towards said end surface to form said plurality of protrusions projecting from said boss, said plurality of protrusions providing mechanical interlocking between said at least two sheets of material to mechanically join said at least two sheets of material so as to form a substantially leakproof joint therebetween.

7. The method of claim 6 wherein said step of extruding includes extruding said portion of said at least two sheets of material laterally relative to said cavity into said plurality of channels to form a plurality of lateral protrusions projecting in a direction away from said boss.

8. The method of claim 6 wherein said step of extruding includes extruding said portion of said at least two sheets of material to form a plurality of equally-spaced protrusions projecting in a direction away from said boss.

9. The method of claim 6 wherein said step of extruding includes extruding said portion of said at least two sheets of material to form a plurality of protrusions projecting radially in a direction away from said boss.

10. A die for use with punch means in a joining operation to form a substantially leakproof joint between sheet materials, said die comprising:

a one-piece die body;

an end surface disposed on one end of said one-piece die body;

a cavity formed in said end surface, said cavity being sized to receive said punch means during said joining operation without piercing said sheet materials, said cavity defining a periphery;

means for mounting said one-piece die body to align with said punch means; and at least one peripheral interruption formed on said periphery of said cavity;

whereby said at least one peripheral interruption provides an extrusion path for a portion of said sheet materials when said punch means is impacted against said sheet materials while positioned against said end surface, said extrusion path for a portion of said sheet materials enhancing the mechanical interlock between said sheet materials without piercing said sheet materials so as to form a substantially leakproof joint therebetween.

11. The die of claim 1 wherein said means for mounting includes means for fixturing said die relative to said punch means.

12. The die of claim 1 wherein said at least one peripheral interruption adjoins said periphery so as to be contiguous with said cavity.

13. The die of claim 1 wherein said at least one peripheral interruption comprises a plurality of peripheral interruptions spaced along said periphery of said cavity.

14. The die of claim 1 wherein said periphery of said cavity is substantially circular in shape.

15. The die of claim 1 wherein said at least one peripheral interruption extends the full width of said end surface.

16. The die of claim 1 wherein said at least one peripheral interruption extends laterally from said cavity.

17. A die for use with a punch to mechanically join at least two sheets of material during a joining operation so as to form a substantially leakproof joint between said at least two sheets of material, said die comprising:

a one-piece die body having a fixturing portion at one end and an end surface disposed at an opposite end of said one-piece die body;

a cavity forming a recessed surface in said end surface, said cavity being sized to receive said punch during said joining operation without piercing said at least two sheets of material, said cavity defining a periphery;

a plurality of channels adjoining said periphery defined by said cavity so as to be contiguous with said cavity; and means for mounting said one-piece die body to align with said punch;

whereby said plurality of channels provides extrusion paths into which a portion of said at least two sheets of material extrude when said punch is impacted against said at least 2 sheets of material while said at least two sheets of material are positioned against said end surface to provide mechanical interlocking between said at least two sheets of material and mechanically join said at least two sheets of material without piercing said at least two sheets of material so as to form a substantially leakproof joint therebetween.

18. The die of claim 17 wherein said means for mounting includes means for fixturing said die relative to said punch.

19. The die of claim 17 wherein said plurality of channels are spaced along said periphery of said cavity.

20. The die of claim 17 wherein said periphery of said cavity is substantially circular in shape.

21. The die of claim 17 wherein each channel of said plurality of channels extends the full width of said end surface.

22. The die of claim 17 wherein each channel of said plurality of channels extends substantially radially from said cavity.

* * * * *